US005425351A

United States Patent [19]

Kozitka

[11] Patent Number: 5,425,351

[45] Date of Patent: Jun. 20, 1995

[54] ARCHERY BOWSTRING POSITIONING APPARATUS

[76] Inventor: John J. Kozitka, R.R. #1, Box 17, Audubon, Minn. 56511

[21] Appl. No.: 44,762

[22] Filed: Apr. 12, 1993

[51] Int. Cl.[6] ..... F41B 5/00

[52] U.S. Cl. ..... 124/88; 124/86; 124/24.1

[58] Field of Search ..... 124/88, 90, 86, 21, 124/231, 24.1, 44.5

[56] References Cited

U.S. PATENT DOCUMENTS

| | | | |
|---|---|---|---|
| 3,557,769 | 1/1971 | Hofmeister | 124/88 |
| 4,061,125 | 12/1977 | Trotter | 124/88 |
| 4,195,616 | 4/1980 | Darlington | 124/88 |
| 4,452,222 | 6/1984 | Quartino | 124/88 |
| 4,704,800 | 11/1987 | Stinson | 124/88 |
| 4,919,107 | 4/1990 | Bunts | 124/88 |
| 5,000,154 | 3/1991 | Slayton | 124/88 |
| 5,002,035 | 3/1991 | Brooks | 124/85 |

*Primary Examiner*—Randolph A. Reese
*Assistant Examiner*—Anthony Knight

[57] ABSTRACT

An elongate positioning leg is secured to a mounting block, that in turn is secured to a bow handle portion in adjacency to the grip, whereupon a bowstring withdrawn relative to the associated bow may be temporarily positioned onto a free end portion of the positioning leg, that includes an entrance slot directed into a cylindrical nesting bore to receive the bowstring permitting subsequent removal of the bowstring and mounting of an arrow thereon.

4 Claims, 4 Drawing Sheets

Fig. 1
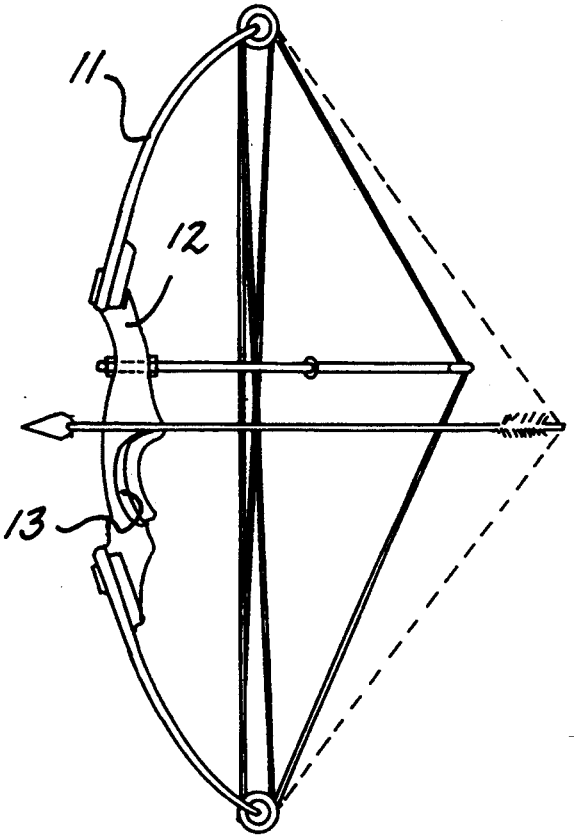
PRIOR ART
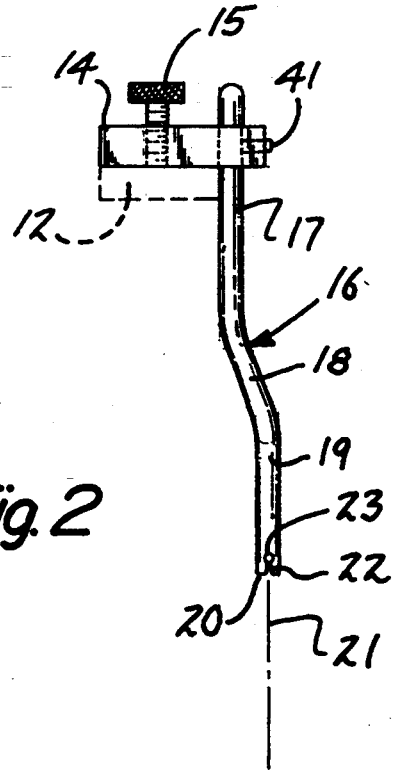
Fig. 2

Fig. 3
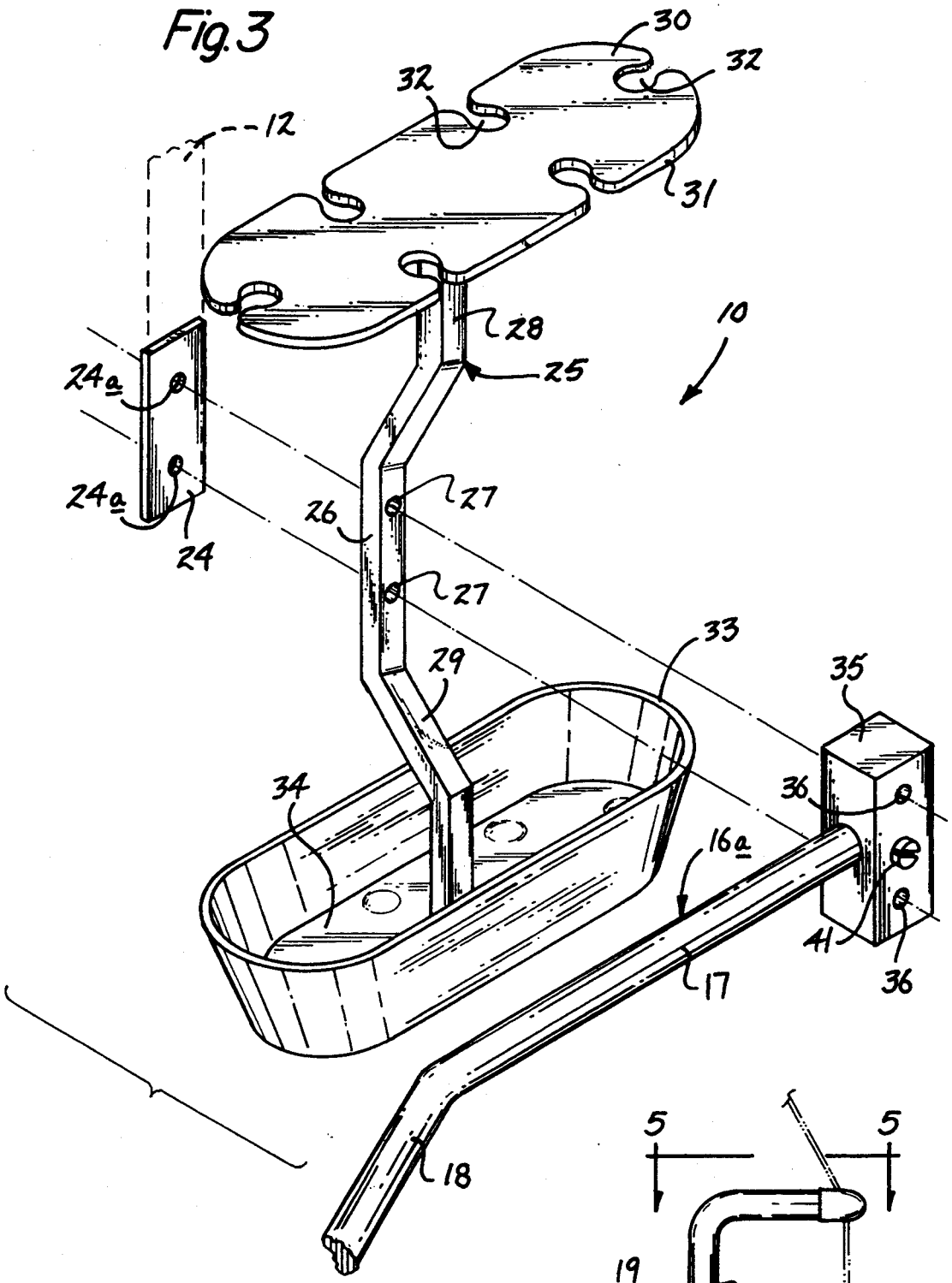
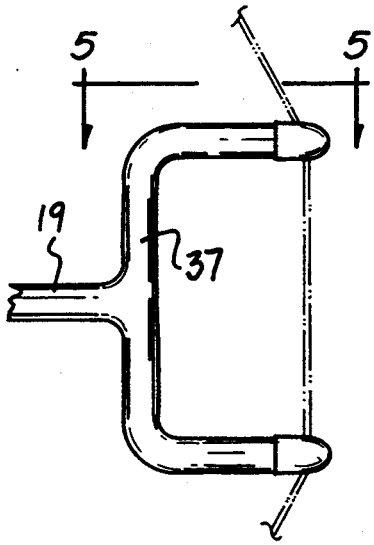
Fig. 4

ARCHERY BOWSTRING POSITIONING APPARATUS

BACKGROUND OF THE INVENTION

1. Field of the Invention

The field of invention relates to archery apparatus, and more particularly pertains to a new and improved archery bowstring positioning apparatus wherein the same is directed to the positioning and locking of a bowstring in a taut orientation relative to an associated bow.

2. Description of the Prior Art

An archery bowstring positioning structure is indicated in U.S. Pat. No. 5,002,035 to Brooks. The Brooks patent utilizes a slot structure having tapering side walls of a generally U-shaped cross-sectional configuration.

The instant invention by contrast employs a narrowed entrance slot directed into a receiving bore, wherein the entrance slot is constricted to insure the bowstring does not inadvertently dislodge relative to the nesting bore subsequent to its intended use by an associated archer and in this respect, the present invention substantially fulfills this need.

SUMMARY OF THE INVENTION

In view of the foregoing disadvantages inherent in the known types of archery apparatus now present in the prior art, the present invention provides an archery bowstring positioning apparatus wherein the same is arranged in mounted securement to an associated archery bow hand grip portion to permit positioning of the bowstring prior to use. As such, the general purpose of the present invention, which will be described subsequently in greater detail, is to provide a new and improved archery bowstring positioning apparatus which has all the advantages of the prior art archery apparatus and none of the disadvantages.

To attain this, the present invention provides an elongate positioning leg secured to a mounting block, that in turn is secured to a bow handle portion in adjacency to the grip, whereupon a bowstring withdrawn relative to the associated bow may be temporarily positioned onto a free end portion of the positioning leg, that includes an entrance slot directed into a cylindrical nesting bore to receive the bowstring permitting subsequent removal of the bowstring and mounting of an arrow thereon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery bowstring positioning apparatus which has all the advantages of the prior art archery apparatus and none of the disadvantages.

It is another object of the present invention to provide a new and improved archery bowstring positioning apparatus which may be easily and efficiently manufactured and marketed.

It is a further object of the present invention to provide a new and improved archery bowstring positioning apparatus which is of a durable and reliable construction.

An even further object of the present invention is to provide a new and improved archery bowstring positioning apparatus which is susceptible of a low cost of manufacture with regard to both materials and labor, and which accordingly is then susceptible of low prices of sale to the consuming public, thereby making such archery bowstring positioning apparatus economically available to the buying public.

Still yet another object of the present invention is to provide a new and improved archery bowstring positioning apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view of the prior art archery bowstring positioning structure, as indicated in the U.S. Pat. No. 5,002,035.

FIG. 2 is an orthographic top view of the positioning arm structure as employed by the invention.

FIG. 3 is an isometric illustration of the archery bowstring positioning structure in association with an archery arrow support structure.

FIG. 4 is an orthographic view of a modified positioning rod structure as employed by the invention.

DESCRIPTION OF THE PREFERRED EMBODIMENT

Figure 5:
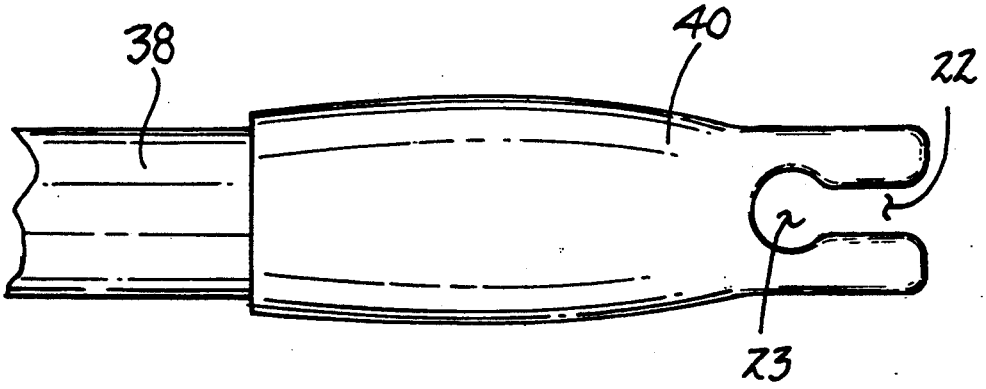
FIG. 5 is an orthographic view, taken along the lines 5—5 of FIG. 4 in the direction indicated by the arrows.
Figure 6:
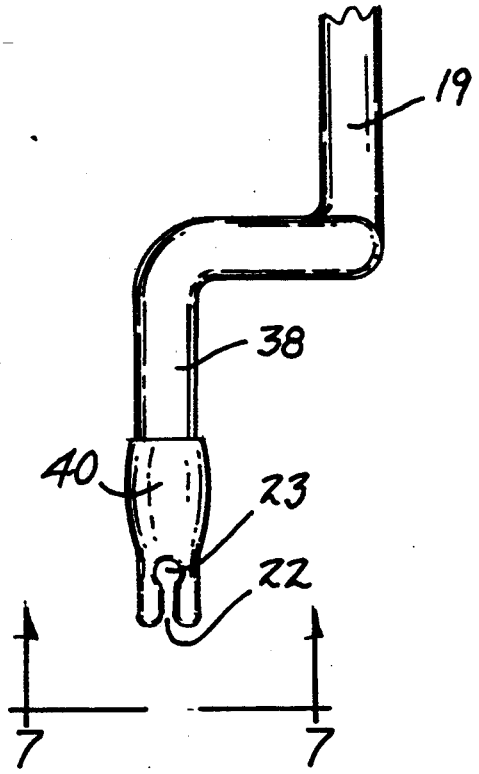
FIG. 6 is an orthographic top view, somewhat enlarged, of the inset structure arranged to include an entrance slot directed into a nesting bore of the organization.
Figure 7:
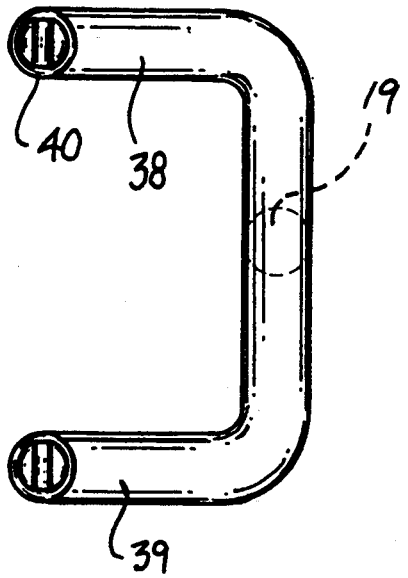
FIG. 7 is an orthographic view, taken along the lines 7—7 of FIG. 6 in the direction indicated by the arrows.

With reference now to the drawings, and in particular to FIGS. 1 to 8 thereof, a new and improved archery bowstring positioning apparatus embodying the principles and concepts of the present invention and generally designated by the reference numeral 10 will be described.

More specifically, the archery bowstring positioning apparatus 10 of the instant invention essentially comprises cooperation with an archery bow 11, having a, bow handle 12, with the handle 12 including a grip position 13, in a manner indicative of the prior art such as indicated in FIG. 1. A mounting block 14 is provided, having a mounting block fastener 15 for securement of the mounting block to the associated archery bow handle 12. A positioning leg 16 is received within the mounting block, with the positioning leg fastener 41 directed into the mounting block for engagement of the positioning leg to affix the positioning leg within the mounting block. The positioning leg 16 includes a respective first, second, and third rod 17, 18, and 19 respectively, with the first rod 17 directed into the mounting block 14, the second rod oriented at an obtuse angle relative to the first rod, and the third rod arranged in a projecting relationship relative to the second rod, as the third rod is arranged in a parallel, offset relationship relative to the first rod. The third rod includes a third rod axis 21, having an entrance slot 22 bisected by the axis at the third rod end wall 20, that in turn is orthogonally oriented relative to the third rod axis. The entrance slot 22 defined by a slot width directed into a cylindrical nesting bore 23, having a bore diameter greater than the slot width such that the bowstring is restricted through the entrance slot 22 and complementarily received within the nesting bore 23 preventing inadvertent removal of the bowstring when directed within the nesting bore 23 in use.

The FIG. 3 of the invention includes an organization to include a handle plate 24 arranged for securement to a side wall of the handle 12, with the handle plate 24 including handle plate apertures 24*a* spaced apart a predetermined spacing. A support bracket 25 is provided, having a support bracket base 26, including base fastener bores 27 directed therethrough spaced apart said predetermined spacing, wherein support bracket first and second support legs 28 and 29 respectively project from opposed ends of the support bracket base 26, wherein the first support leg 28 mounts an arrow guide plate 30 in a fixed orthogonal relationship relative to the first support leg, with the arrow guide plate 30 having a periphery 31 including a plurality of peripheral slots 32 to receive an arrow, wherein a support bucket 33 having a bucket floor 34 is oriented such that the bucket floor 34 is arranged parallel relative to the guide plate 30 and the floor 34 is orthogonally mounted to a free end or lowermost distal end of the second support leg 29.

Figure 8:
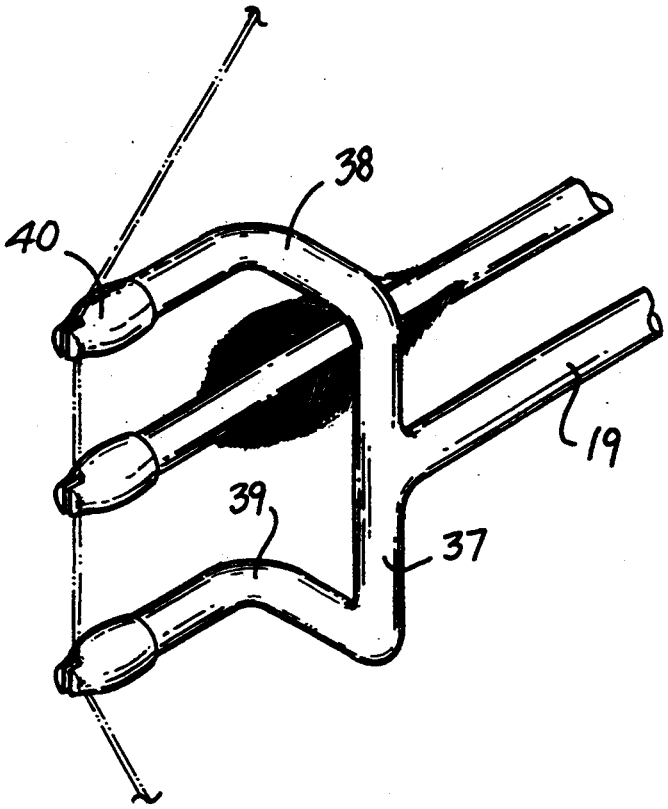
FIG. 8 is an isometric view of the modified bowstring support structure mounted to the positioning rod, of a type as indicated in FIG. 4.

A modified mounting block 35 is provided, having mounting block bores 36 directed therethrough spaced apart said predetermined spacing. It should be understood therefore that conventional fasteners (not shown) are directed through the mounting block bores 36, the base fastener bores 27, and the handle plate apertures 24*a*. To the second rod 18, as indicated in FIG. 3, the third rod 19, as indicated in FIG. 2, may be oriented and secured in a manner as described relative to FIG. 2, or alternatively, as indicated in FIG. 8, a fourth leg 37 orthogonally bisected by the third rod portion 19 is provided, wherein the fourth leg 37 includes first and second L-shaped positioning legs 38 and 39 that are parallel relative to one another and orthogonally oriented relative to the fourth leg 37. Each of the positioning legs 38 and 39 includes a polymeric head 40, with each polymeric head 40 provided with the associated entrance slot 22 and nesting bore 23, wherein the entrance slot 22 and the nesting bore 23 of the respective first and second positioning legs 38 and 39 are arranged in mirror image facing relationship relative to one another. In this manner, the bowstring, such as indicated in phantom in FIG. 8, is directed between the first and second positioning legs 38 and 39 such as the arrow, such as indicated in FIG. 8, may be mounted thereon without initially removing the arrow from the positioning legs 38 and 39.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An archery bowstring positioning apparatus arranged for mounting to an archery bow, wherein the archery bow includes, an archery bow handle and an archery bow grip portion, with the apparatus arranged for mounting to the archery bow handle, and wherein the apparatus comprises, a mounting block arranged for securement to the archery bow handle, the mounting block including fastener means directed through the mounting block for securement to the archery bow handle, and a positioning leg secured to the mounting block, the positioning leg including a first rod secured to the mounting block, and a second rod secured to the first rod offset relative to the first rod, and a third rod mounted to the second rod, wherein the third rod is arranged parallel to and offset relative to the first rod, and the third rod includes mounting means for receiving a bowstring of the archery bow therewithin, and a support bracket fixedly secured to the mounting block between the mounting block and the archery bow handle, wherein the support bracket includes a bracket base, the bracket base arranged for securement to the fastener means, and a first support leg and a second support leg mounted to opposed ends of the support bracket base, with the first leg having an arrow guide plate fixedly and secured to the first support leg, the arrow guide plate including a plate periphery and the periphery including a plurality of slots directed into the plate from the plate periphery, and the second support leg having a support bucket, with the support bucket including a bucket floor, and the bucket floor orthogonally and fixedly mounted to the second support leg, wherein the support bucket floor is spaced from the guide plate, and a fourth leg fixedly mounted to the third rod, and the fourth leg having respective first and second L-shaped positioning legs fixedly mounted to opposed ends of the fourth leg in a spaced, facing relationship relative to one another, and the first positioning leg and the second positioning leg each include said mounting means at a free end of each positioning leg.

2. An apparatus as set forth in claim 1 wherein the mounting means includes an entrance slot, and the entrance slot having a slot width, and the mounting means further includes a cylindrical nesting bore in communication with the entrance slot, with the nesting bore orthogonally oriented relative to the entrance slot, and the nesting bore having a bore diameter greater than the slot width.

3. An apparatus as set forth in claim 2 wherein the mounting block further includes a plurality of mounting block bores, wherein each of the mounting block bores is in alignment with one of the base fastener bores.

4. An archery bowstring positioning apparatus arranged for mounting to an archery bow, wherein the archery bow includes an archery bow handle and an archery bow grip portion, with the apparatus arranged for mounting to the archery bow handle, and wherein the apparatus comprises, a mounting block arranged for securement to the archery bow handle, the mounting block including fastener means directed through the mounting block for securement to the archery bow handle, and a positioning leg secured to the mounting block, the positioning leg including a first rod secured to the mounting block, and a second rod secured to the first rod offset relative to the first rod, and a third rod mounted to the second rod, wherein the third rod is arranged parallel to and offset relative to the first rod, and the third rod includes mounting means for receiving a bowstring of the archery bow therewithin, and a fourth leg fixedly mounted to the third rod, and the fourth leg having respective first and second L-shaped positioning legs fixedly mounted to opposed ends of the fourth leg in a spaced, facing relationship relative to one another, and the first positioning leg and the second positioning leg each include said mounting means at a free end of each positioning leg.

* * * * *